United States Patent [19]

Corey

[11] Patent Number: 4,483,143

[45] Date of Patent: Nov. 20, 1984

[54] INTEGRAL FINNED HEATER AND COOLER FOR STIRLING ENGINES

[75] Inventor: John A. Corey, North Troy, N.Y.

[73] Assignee: Mechanical Technology Incorporated, Latham, N.Y.

[21] Appl. No.: 423,528

[22] Filed: Sep. 24, 1982

[51] Int. Cl.[3] ..... F02G 1/04

[52] U.S. Cl. ..... 60/526; 92/172

[58] Field of Search ..... 92/172; 60/516, 517, 60/526

[56] References Cited

U.S. PATENT DOCUMENTS 2,803,951 8/1957 Newton ..... 92/172 X 3,173,697 3/1965 Doperalski ..... 92/172 X 3,636,719 1/1972 Sato et al. ..... 62/6

*Primary Examiner*—Allen M. Ostrager

*Attorney, Agent, or Firm*—Joseph V. Claeys; Arthur N. Trausch, III

[57] ABSTRACT

A piston and cylinder for a Stirling engine and the like having top and bottom meshing or nesting finned conical surfaces to provide large surface areas in close proximity to the working gas for good thermal (addition and subtraction of heat) exchange to the working gas and elimination of the usual heater and cooler dead volume. The piston fins at the hot end of the cylinder are perforated to permit the gas to pass into the piston interior and through a regenerator contained therein.

16 Claims, 6 Drawing Figures

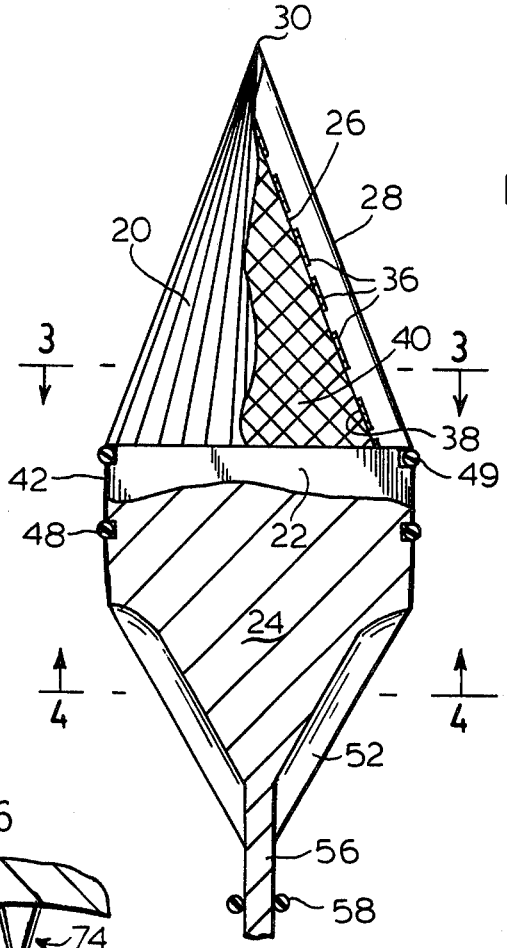
FIG.2
FIG.4
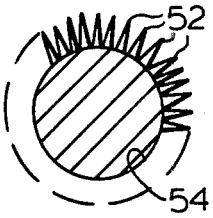
FIG.6
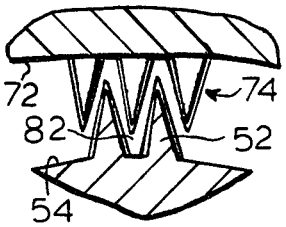
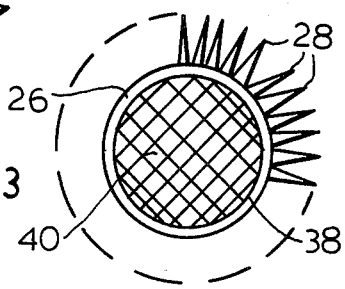
FIG.3
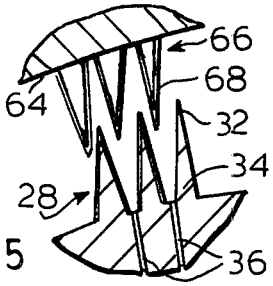
FIG.5

INTEGRAL FINNED HEATER AND COOLER FOR STIRLING ENGINES

The Government of the United States of America has rights in this invention pursuant to Contract No. DEN 3-32 awarded by the U.S. Department of Energy.

FIELD OF THE INVENTION

The present invention is directed towards an integral heat exchanger and improved piston and cylinder design for use in an engine, particularly a Stirling engine.

BACKGROUND OF THE INVENTION

With the renewed interest in Stirling engines there has been ever increasing attempts to improve engine efficiency and reduce cost so as to produce a cost effective product. One of the means of improvements in this regard includes variations in the design of the piston and cylinder head as for example can be seen in U.S. Pat. Nos. 4,271,669 issued June 9, 1981; 3,899,888 issued Aug. 19, 1975; and 3,636,719 issued Jan. 25, 1972. These representative engines are an attempt to maximize the isothermal change in condition and thereby improve the degree of thermal efficiency of the engine. However, while such arrangements may be more efficient than prior devices, the designs are relatively complicated, difficult to manufacture, expensive or subject to other disadvantages such as excessive dead volume. This inhibits the engine cycle performance, limiting their application.

Accordingly, current Stirling production engines usually utilize a separate heater or cooler volume in addition to the main expansion volume. This practice has the disadvantage of increasing the overall volume resulting in relatively unproductive (thermodynamically) working gas volume and requiring alternative multiple parts which increase the failure probabilities and raise costs.

In my copending application entitled "Integral Finned Heater/Cylinder Head for Stirling Engines" filed concurrently herewith, under Ser. No. 423,526, and incorporated by reference, there is disclosed a cylinder head and piston which are formed into an interlocking relationship via a conical finned piston and correspondingly finned internal surface of the cylinder head at the hot end of the cylinder. The piston is hollow having a regenerator therein through which a working gas can pass eliminating a portion of the excess working volume attributable to a separate regenerator.

The present invention is directed towards further improving on this concept.

SUMMARY OF THE INVENTION

Accordingly, it is an object of the present invention to provide for an engine cylinder with a mating piston which is also a thermally efficient heater and cooler, yet relatively simple in construction and with relatively fewer, more durable parts that do not require additional volume of working gas.

It is a further object of the invention to provide an engine cylinder and a mating piston which may include a regenerator and a finned cooler which minimizes dead volume and manufacturing expense.

The present invention provides a cylinder head and piston for an engine, particularly a Stirling engine, which are formed in an interlocking, meshing or nesting relationship via a conical finned piston and a corresponding conical finned internal surface of the cylinder head. The interlocking fins provide large surface areas having close proximity to the working gas to allow for both superior heating of the working gas in the hot end of the working chamber and cooling of the working gas in the cold end of the chamber. The fins also serve to provide flow channels or guides for the combustion gas and cooling fluid about the cylinder and working gas therein.

Further, the oblique motion of the piston fins with the interlocking head fins produce an effectively narrow, deep passage for efficient heat transfer yet allow for a shallower, relatively easy construction of the fins. Also, this motion allows for an effective longer piston stroke for a given fin height without the disengagement of mating fins so as to maximize the thermal transfer.

Further, the large surface to volume ratio maximizes heat exchange and the cone-like configuration improves structural integrity.

BRIEF DESCRIPTION OF THE DRAWINGS

Thus by the aforenoted invention its objects and advantages and others will be realized, the description of which should be taken in conjunction with the following drawings wherein:

FIG. 2 is a sectional view of the piston incorporating the teachings of the present invention;

FIG. 3 is a top sectional view of the piston taken along lines 3—3 of FIG. 2;

FIG. 4 is a bottom sectional view of the piston taken along lines 4—4 of FIG. 2;

FIG. 5 is an enlarged partial view of the mating relationship between the cylinder head and the piston in the hot end of the working chamber; and FIG. 6 is an enlarged partial view of the mating relationship between the cylinder head and the piston at the cold end of the working chamber.

DETAILED DESCRIPTION OF THE PREFERRED EMBODIMENT

Figure 1:
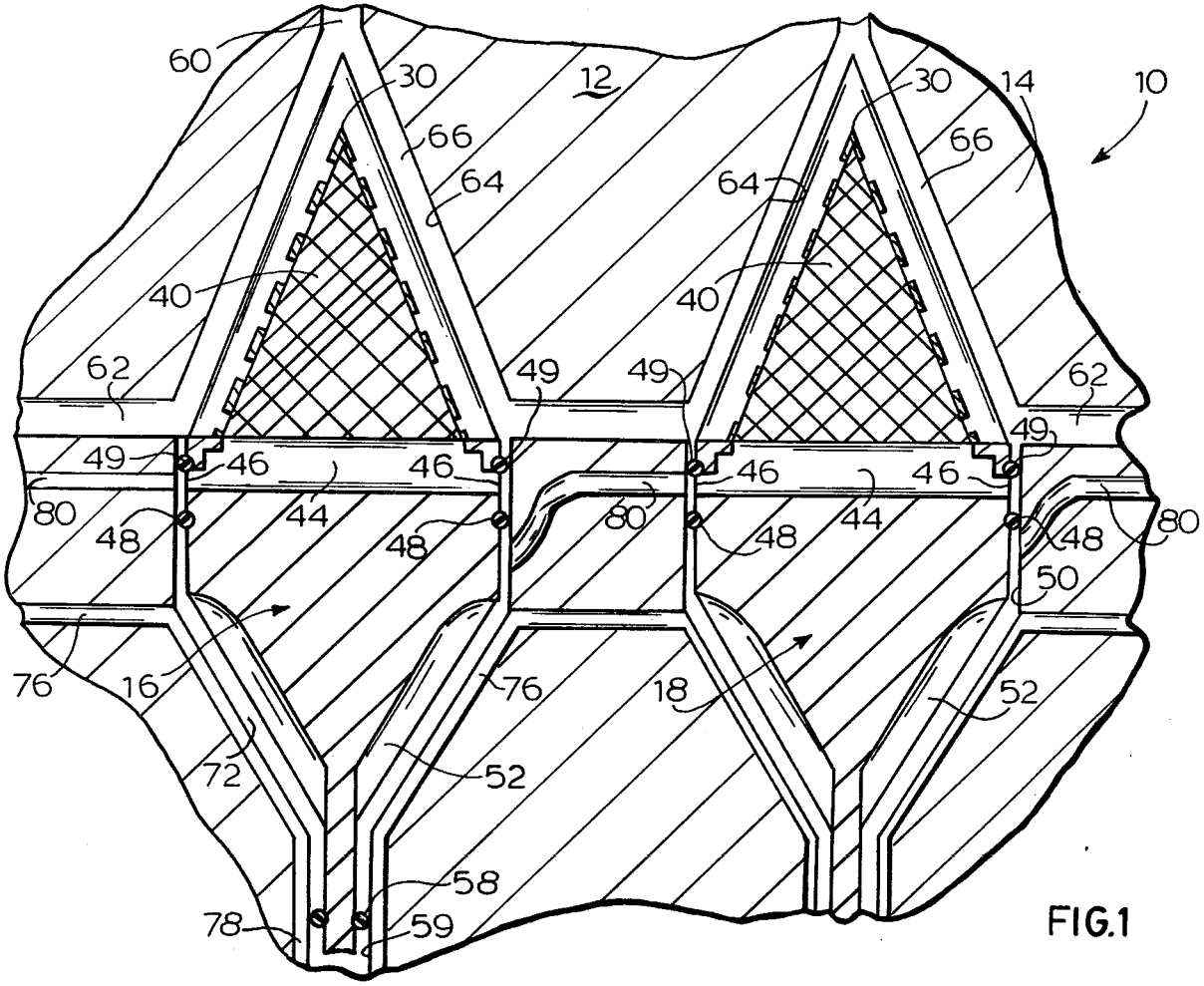
FIG. 1 is a partially cross sectional view of a cylinder head with mating piston having an integral heat exchanger, regenerator and finned cooler, incorporating the teachings of the present invention.

With reference now to the drawings, there is shown in FIG. 1 a cylinder head 10, particularly one for a Stirling engine, which comprises cylinder housings 12 and 14. Disposed in the housings 12 and 14 are pistons 16 and 18 respectively, operationally coupled in a typical Stirling engine manner. Note that while only two cylinders are shown, they are used merely as an example since the present invention may be incorporatedd into a single or multi-cylinder engine (preferably 3-6 cylinders, for proper phase angles) with slight modifications, as will be apparent to those skilled in the art. Pistons 16 and 18 are identically constructed as illustrated in FIG. 2 and comprise an upper conical member 20 coupled to a cylindrical portion 22 which may be integral therewith, which in turn is coupled to a lower conical member 24. Upper and lower conical members 20 and 24 are to be positioned in the hot and cold end respectively of the cylinder as will be apparent.

Located on the entire exterior surface 26 of the conical member 20 are a plurality of vertical or axially-orientated piston fins 28, which are seen more clearly with reference to FIGS. 3 and 5. The piston fins 28 extend the length of the conical member 20 forming a tip or apex 30 and terminating at portion 22. The individual piston fins 28 themselves may be solid and integral with the conical member 20 if so desired. The fins are generally formed in a wedge shape starting from a radially outward edge 32 and flaring radially inwardly to a base 34 on the exterior surface 26. Between the adjacent bases 34 of the fins 28 there is provided a series of perforations 36 (see particularly FIG. 5) along the length of the conical member 20 to allow access between the piston exterior surface 26 and the conical hollow interior surface 38, which is defined by a conical hollow therein. Advantageously, located within the hollow is a regenerator 40 which may be constructed of standard regenerator material.

The ingress and egress of working fluid to the regenerator 40 is assisted (aside from the perforations 36) by way of the piston coupling to the interior of cylindrical portion 22. Access from the interior to the exterior surface 42 of the cylindrical portion 22 is via channel 44 with opening(s) 46 for the channel 44 disposed between adjacent sealing rings 48 and 49, positioned on exterior 42 which provide a sliding seal between the cylindrical portion 22 and the adjacent cylindrical interior surface 50 of the head.

The lower conical member 24 is shown solid and integral with cylindrical portion 22. This member 24 also includes a plurality of fins 52 on its outer exterior surface 54 as shown by FIGS. 4 and 6. Similarly, these fins 52 extend the length of the conical member 24 from cylindrical portion 22 to shaft 56, which is coupled to a crank shaft, for example, (not shown). A sealing ring 58 is provided and is slidably disposed between shaft 56 and channel surface 59 to effect a sliding seal therebetween.

In the cylinder head 10, the respective cylinder housings 12 and 14 may be enclosed by a pressure vessel with respective combustion gas inlet and outlet ports 60 and 62 provided through which passes hot combustion gas or liquid from the combustor or heater (not shown).

The internal cavity surface 64 of the upper or hot end of the cylinder housing, is formed of a conical hollow larger than the adjacent upper portion of the piston to allow the movement therein of conical member 20. On surface 64 is positioned a plurality of hollowed vertical fins 66 which are coupled to the inlet port 60 and outlet port 62. These fins 66 correspond in a mating or nesting-like fashion to piston fins 32 in an alternating fashion as shown most clearly in FIG. 5. Note that the fins 66 are supported by the pressure vessel (not shown) of cylinder head 10 which serves to pick up the hoop stress thereon. Due to radial loading of the pressure on the head's interior, the fin walls 68 can be fabricated out of relatively thin material. This allows for effective and more nearly isothermal transfer from the combustion gas passing through the interior of fins 66 to the working gas which is positioned in the space between fins 28 and 66, generally indicated at 70. Note that the interlocking fins 28 and 66 provide large working surfaces within close proximity to the working gas so as to provide for efficient heat exchange from the combustion gas. Fins 66 also provides a flow channel for the combustion gas.

In this regard, as can be seen in FIG. 1, combustion gas enters the head 10 via port 60 and passes through fins 66 and out port 62. The heat exchanged through fins 66 causes a heating or expansion of the working gas in the adjacent cylinder head 12 in space 70, causing the working gas to expand against the piston forcing it downward. Due to the perforations 36 in the piston a short path to the next element, that being the regenerator 40 is established advantageously avoiding excessive shear pressure which would result if the heated working gas was required to travel from the piston nose tip 30 along the entire outside of the piston 12.

The piston fin 28 and head fin 66 arrangement (i.e., conically and obliquely engaged) allows the piston to have a relatively short stroke for longer engagement therebetween providing obviously more effective thermal coupling.

With reference now to the lower or cold end of the cylinder housing there is provided an interior cavity or chamber surface 72 which is similarly formed out of a conical hollow larger than the adjacent portion of the piston to allow movement therein of conical member 24. On surface 72 there are disposed hollow cooling fins 74 in which passes a cooling fluid via inlet and outlet ports 76 and 78 (see particularly FIGS. 1 and 6). Note, the advantages of this arrangement are the same as that set forth in the discussion regarding the hot end and the piston may be integrally constructed as a monolithic structure to reduce its cost.

The cold end of the cylinder receives cyclic working gas from the hot end of the adjacent cylinder via channel(s) 80. During each piston cycle, one end of channel 80 is disposed adjacent opening 46 of channel 44, between seals 48 and 49, and an opposite end of 80 is disposed adjacent chamber 72, below seal 48. The working gas now passes through a cooling space 82 which is defined by fins 52 and 74 which results in cooling the working gas. In operation, the working gas is shuttled back forth from the heated end of one cylinder to the cooler end of another by the pistons which reciprocate axially within the housing generating the periodic pressure wave in the working gas. The working gas movement results in useful work within typical Stirling engine principles.

Thus by the aforenoted invention its objects and advantages are readily realized and although a preferred embodiment has been disclosed and described in detail herein, its scope should not be limited thereby, rather its scope should be determined by that of the appended claims.

What is claimed is:

1. A piston for use in a cylinder head of a Stirling type engine and the like, said piston comprising:

first and second conical portions axially aligned and said respective conical portions having exterior surfaces on which are radially disposed a plurality of vertical fins;

said first conical portion including an interior surface defining a piston cavity;

regenerator means disposed in said piston cavity; and passage means between the interior and exterior surface of said first conical portion.

2. The piston in accordance with claim 1 wherein said passage means includes perforations in the piston passing between the exterior surface of the first conical portion and the interior surface and said perforations being located between adjacent fins on the exterior surface of the first conical portion.

3. A piston in combination with a cylinder head for use in a Stirling engine and the like, comprising:

a piston having first and second conical portions axially aligned and said respective conical portions having exterior surfaces on which are radially disposed a plurality of vertical fins;

said first conical portion including an interior surface defining a piston cavity;

regenerator means disposed in said piston cavity;

passage means between the interior and exterior surface of said first conical portion;

a cylinder head having first and second conical cylinder cavities therein adapted to receive the piston and accordingly said respective conical portions for reciprocal movement therein; and said cavity having radially disposed thereon a plurality of vertical fins arranged in a mating like fashion with the respective fins on the respective conical portions of the piston during operation of the engine.

4. The combination in accordance with claim 3 wherein said passage means includes perforations in the piston passing between the exterior surface of the first conical portion and the interior surface and said perforations being located between adjacent fins on the exterior surface of the first conical portion.

5. The combination in accordance with claims 3 or 4 which includes a cylinder wall; a plurality of said cylinder cavity fins being hollow and supported by the cylinder wall; a plurality of said cylinder cavity fins in the first cavity for passing a a combustion gas therethrough; and a plurality of said cylinder cavity fins in the second cavity for passing a cooling fluid therethrough.

6. The combination in accordance with claim 5 wherein said cylinder fins and piston fins are wedge shaped having an edge and an enlarged base and disposed such that the edge of a piston fin is adapted to be radially positioned between the bases of adjacent cylinder fins and vice versa.

7. The combination in accordance with claim 6 wherein said cylinder fins and piston fins are arranged in a conical and oblique relationship so as to maximize the heat transfer between said combustion gas and said working gas in said first cavity and said cooling fluid and said working gas in said second cavity.

8. The combination in accordance with claim 7 wherein the surface area of the cylinder fins and the piston fins exposed to the working gas in the first and second cavities is maximized relative to the working gas volume.

9. A piston for use in a cylinder head of a Stirling type engine and the like, said piston comprising:

a conical portion having an exterior surface on which is radially disposed a plurality of vertical fins;

an interior surface defining a piston cavity;

regenerator means disposed in said piston cavity; and passage means between the interior and exterior surface.

10. The piston in accordance with claim 9 wherein said passage means includes perforations in the piston passing between the exterior surface and the interior surface and said perforations being located between adjacent fins on the piston.

11. A piston in combination with a cylinder head for use in a Stirling engine and the like comprising:

a piston having a conical portion having an exterior surface on which is radially disposed a plurality of vertical fins;

an interior surface defining a piston cavity;

regenerator means disposed in said piston cavity;

passage means between the interior and exterior surface;

a cylinder head having a conical cylinder cavity therein adapted to receive the conical portion of the piston for reciprocal movement therein; and said cylinder cavity having radially disposed thereon a plurality of vertical fins arranged in a mating like fashion with the vertical fins on the conical portions of the piston during operation of the engine.

12. The combination in accordance with claim 11 wherein said passage means includes perforations in the piston passing between the exterior surface and the interior surface and said perforations being located between adjacent fins on the piston.

13. The combination in accordance with claims 11 or 12 which includes a cylinder wall; a plurality of said cylinder cavity fins being hollow and supported by the cylinder wall; a plurality of said cylinder cavity fins in the cylinder cavity for passing a combustion gas therethrough.

14. The combination in accordance with claim 13 wherein said cylinder fins and piston fins are wedge shaped having an edge and an enlarged base and disposed such that the edge of a piston fin is radially positioned between the bases of adjacent cylinder fins and vice versa.

15. The combination in accordance with claim 14 wherein said cylinder fins and piston fins are arranged in a conical and oblique relationship so as to maximize the heat transfer between said combustion gas and said working gas in said cylinder cavity.

16. The combination in accordance with claim 15 wherein the surface area of the cylinder fins and the piston fins exposed to the working gas in the cylinder cavity is maximized relative to the working gas volume.

* * * * *